United States Patent [19]

Takahashi et al.

[11] 3,974,045

[45] Aug. 10, 1976

[54] METHOD FOR ELECTROPLATING BRIGHT ZINC

[75] Inventors: Akio Takahashi, Kisarazu; Atsushi Fukuda; Toshio Igarashi, both of Tokyo, all of Japan

[73] Assignee: Dipsol Chemicals Co., Ltd., Tokyo, Japan

[22] Filed: Nov. 25, 1974

[21] Appl. No.: 526,950

Related U.S. Application Data

[62] Division of Ser. No. 448,545, March 6, 1974, abandoned.

[52] U.S. Cl. ..... 204/55 R; 204/55 Y; 260/2 BP

[51] Int. Cl.[2] ..... C25D 3/22; C25D 3/24

[58] Field of Search ..... 204/55 R, 55 Y, 43 Z, 204/44, 114

[56] References Cited

UNITED STATES PATENTS

| | | | |
|---|---|---|---|
| 3,655,534 | 4/1972 | Kampe | 204/55 R |
| 3,803,008 | 4/1974 | Rosenberg et al. | 204/55 Y |
| 3,838,026 | 9/1974 | Koch | 204/55 R |
| 3,853,718 | 12/1974 | Creutz | 204/55 R |
| 3,869,358 | 3/1975 | Nobel et al. | 204/55 Y |
| 3,915,815 | 10/1975 | Koch | 204/55 Y |

*Primary Examiner*—G. L. Kaplan
*Attorney, Agent, or Firm*—Oblon, Fisher, Spivak, McClelland & Maier

[57] ABSTRACT

A brightener additive for zinc electroplating baths, which comprises: a water-soluble polymer prepared by the reaction of an epihalohydrin with a nitrogen heterocyclic compound such as the compounds of imidazole, pyrrole, cyclic amine of the formula:

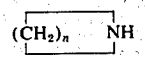

and piperazine in the presence of a nitrogen compound such as the compounds of aliphatic amines, hexamethylenetetramine and ammonia.

9 Claims, No Drawings

METHOD FOR ELECTROPLATING BRIGHT ZINC

This is a division of application Ser. No. 448,545 filed Mar. 6, 1974, now abandoned.

BACKGROUND OF THE INVENTION

1. Field in the Invention

This invention relates to a modified brightener additive for the electrodeposition of bright zinc from a zinc electroplating bath such as cyandide, zincate or chloride bath.

2. Description of the Prior Art

This inventors have found a brightener additive for the electrodeposition of bright zinc from zinc electroplating baths, which comprises a water-soluble polymer prepared by the reaction of at least one epihalohydrin with at least one nitrogen heterocyclic compound (U.S. Application Ser. No. 413,673), but when the brightener additives are used in electroplating baths, bright zinc is electrodeposited with a low current efficiency (30–60%).

SUMMARY OF THE INVENTION

Accordingly, one object of the present invention is to provide a brightener additive which is well suited for electrodepositing zinc efficiently for various types of zinc electroplating baths.

Briefly, this object and other objects of the invention as hereinafter will becme more readily apparent can be attained by providing a brightener additive for zinc electroplating baths which comprises a water-soluble polymer prepared by reacting at least epihalohydrin with at least one nitrogen heterocyclic compound such as the compounds of imidazole, pyrrole, cyclic amine of the formula:

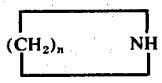

wherein $n$ is 2–5 and piperazine in the presence of at least one nitrogen compound such as the compounds of aliphatic amines, hexamethylenetetramine and ammonia.

DESCRIPTION OF THE PREFERRED EMBODIMENTS

The nitrogen heterocyclic starting materials for the preparation of the water soluble polymer brighteners of the invention include imidazole, pyrrole, derivatives thereof and other nitrogen-heterocyclic compounds wherein a ring hydrogen atom and/or the hydrogen atom of the imino radical are substituted with an OH, alkyl, amino or acetyl radical. Suitable specific starting nitrogen heterocyclic compounds include 1-methylimidazole, 2-methylimidazole, 1,4-dimethylimidazole, 4-hydroxy-2-aminoimidazole, 5-ethyl-4-hydroxyimidazole, 2,5-dimethylpyrrole, 1-ethylpyrrole, 1-acetylpyrrole and 1-methyl-pyrrole. Other useful nitrogen heterocyclic compounds include derivatives of cyclic imines wherein a hydrogen atom and/or the imino radical are replaced with an alkyl, amino or acetyl radical. Suitable cyclic imines include ethyleneimine, pyrrolidine, piperidine, polyethyleneimine and 1-methylpiperidine and other useful nitrogen heterocyclic compounds include derivatives of piperazine, wherein a hydrogen atom and/or an imino are substituted with an alkyl or acetyl radical. Suitable derivatives or piperazine include such as N,N-dimethylpiperazine, N,N-diethypiperazine, 1,4-ethylenepiperazine and 2,5-dimethylpiperazine.

The nitrogen compounds for the preparation of the water soluble polymer brighteners of the invention include aliphatic amines, hexamethylenetetramine and ammonia. Suitable aliphatic amines contain methylamine, dimethylamine, ethylamine, diethylamine, triethylamine, ethylenediamine, diethylentriamine and the like. It is preferable to use especially lower molecular weight nitrogen compounds among the above nitrogen compounds.

The epihalohydrins include epichlorohydrin and epibromohydrin.

The water-soluble polymer brightener additives can be prepared by adding at least one epihalohydrin to at least one nitrogen heterocyclic compound and at least one nitrogen compound in quantities ranging from 0.2–5 moles of epihalohydrin and 0.2–10 moles of nitrogen compound per mole of nitrogen heterocyclic compound and then reacting the material in the presence of water for above 30 minutes at 50°–100°C.

The brightener additives prepared by this procedure are low molecular weight water-soluble polymers and their precise structures are presently under investigation. The brightener additives once prepared are diluted several times with water and then added to the electroplating bath in ratios of 0.5–10 cc/1.

The product brighteners of this invention once electrodeposited with the plated zinc exhibit a considerably enhanced brightening effect and current efficiency (65–95%) and a range of brightness superior to the conventional additives used in zinc electroplating baths. The current efficiency varies with the kind of zinc plating baths and the product brighteners.

The brightener additives of the prior art hereinafter disclosed can be added to the brightener additives of this invention, if desired.

, Having generally described this invention, a further understanding can be obtained by reference to certain specific examples which are provided herein for purposes of illustration only and not intended to be limiting unless otherwise specified. The Examples show the preparation of some of the brightener additives of the present invention.

EXAMPLE 1

A 15g quantity of 1-methylimidazole, 40g of dimethylamine (30% solution) and 100g of water were added to a four necked flask of 300cc equipped with a thermometer, a condenser, an agitator and a separatory funnel. The solution was stirred and the solid material dissolved. The solution was warmed to 60°C and 40g of epichlorohydrin was added dropwise over 30 minutes to the flask while the stirred solution was maintained at 80°C. The reaction was completed by stirring the solution for 2 hours at 80°C after the addition of the epichlorohydrin.

EXAMPLE 2

A 15g quantity of imidazole, 40g of 20% ammonium solution and 80g of water were added to a 300cc four necked flask which was used in Example 1. The mixture was dissolved with stirring. The solution was warmed to 40°C and 30g of epichlorohydrin was added dropwise while stirring. The stirred solution was raised to 85°C after addition of the epichlorohydrin. The reaction was completed by stirring the solution for 90 minutes at 85°C.

EXAMPLE 3

A 12g quantity of 1-vinylimidazole, 20g of ethylenediamine and 70g of water were added to a 300cc four necked flask which was used in Example 1. The mixture was dissolved with stirring. The solution was warmed to 50°C and 30g of epichlorohydrin was added dropwise while stirring over 30 minutes. The solution was stirred for 30 minutes after addition of the epichlorohydrin, and then was raised to 85°C. The reaction was completed by stirring the solution for 90 minutes at 85°C.

EXAMPLE 4

A 20g quantity of pyrrole, 10g of hexamethylenetetramine and 100g of water were added to a 300cc four necked flask which was used in Example 1. The mixture was dissolved with stirring. The solution was warmed to 50°C and 40g of epichlorohydrin was added dropwise while stirring over 40 minutes while maintaining the solution to 50°–60°C. The stirred solution was raised to 90°C after addition of the epichlorohydrin. The reaction was completed by stirring the solution for 90 minutes at 90°C.

EXAMPLE 5

A 30g quantity of N,N-dimethylpiperazine, 10g of ethylenediamine and 120g of water were added to a four necked flask which was used in Example 1. The solution was stirred and the solid material was dissolved. The solution was warmed to 60°C and 55g of epichlorohydrin was added dropwise over 40 minutes to the flask stirring the solution. The stirred solution was raised to 85°C after addition of the epichlorohydrin. The reaction was completed by stirring the solution for 2 hours at 85°C.

EXAMPLE 6

A 5g quantity of 2-methylimidazole, 12g of piperidine, 20g of monoethylylamine and 80g of water were added to a four necked flask which was used in Example 1. The solution was stirred and the solid material was dissolved. The solution was warmed to 50°C and 30g of epichlorohydrin was added dropwise. After the solution was stirred for 30 minutes, the stirred solution was raised to 90°C. The reaction was completed by stirring the solution for 2 hours at 90°C.

EXAMPLE 7

A 10g quantity of pyrrolidine, 7g of imidazole, 20g of diethylamine and 120g of water were added to a four necked flask which was used in Example 1. The solution was stirred and the solid material was dissolved. The solution was warmed to 40°C and 40g of epichlorohydrin was added dropwise. The stirred was raised to 60°C after addition of the epichlorohydrin. After the reaction was raised to 90°C and the reaction was completed by stirring the solution for 2 hours at 90°C.

The brightener additive solutions prepared in each Example Nos. 1–7 were diluted to 200g with water, and the diluted solutions were added to the following electroplating baths, that is, zincate bath (Z), bath of medium cyanide concentration (M-C), bath of low cyanide concentration (L-C) and chloride bath (Cl). The composition of the baths is as follows:

| Composition | | Kind of Bath | | | |
|---|---|---|---|---|---|
| | | Zn | Cl | M-C | L-C |
| Zinc metal | g/l | 10 | — | 20 | 10 |
| NaOH | g/l | 120 | — | 80 | 80 |
| NaCN | g/l | — | — | 40 | 120 |
| Metal/NaCN | (weight ratio) | — | — | 2.0 | 1.25 |
| $ZnCl_2$ | g/l | — | 35 | — | — |
| $NH_4Cl$ | g/l | — | 100 | — | — |

The electroplating of zinc on steel was performed by passing an electric current (current density: $3^A/dm^2$) at a bath temperature of 25°C. The obtained results are shown in the following table.

| Example No. | 1 | 2 | 3 | 4 | 5 | 6 | 7 | 1' | 3' | 6' |
|---|---|---|---|---|---|---|---|---|---|---|
| Kind of Bath: Z | | | | | | | | | | |
| Amount of Addition (g/l) | 3 | 3 | 3 | 3 | 3 | 3 | 3 | 3 | 3 | 3 |
| Brightness of Zinc | G | G | G | G | G | G | G | G | G | G |
| Current Efficiency at the Cathode (%) | 75 | 70 | 73 | 76 | 69 | 75 | 65 | 46 | 42 | 39 |
| Kind of Bath: Cl | | | | | | | | | | |
| Amount of Addition (g/l) | 2 | 2 | 2 | 2 | 2 | 2 | 2 | 2 | 2 | 2 |
| Brightness of Zinc | G | G | G | G | G | G | G | G | G | G |
| Current Efficiency at the Cathode (%) | 95 | 91 | 96 | 97 | 89 | 96 | 87 | 65 | 64 | 63 |
| Kind of Bath: M-C | | | | | | | | | | |
| Amount of Addition (g/l) | 0.5 | 0.5 | 0.5 | 0.5 | 0.5 | 0.5 | 0.5 | 0.5 | 0.5 | 0.5 |
| Brightness of Zinc | G | G | G | G | G | G | G | G | G | G |
| Current Efficiency at the Cathode (%) | 78 | 76 | 79 | 80 | 72 | 80 | 69 | 51 | 49 | 45 |
| Kind of Bath: L-C | | | | | | | | | | |
| Amount of Addition (g/l) | 1 | 1 | 1 | 1 | 1 | 1 | 1 | 1 | 1 | 1 |
| Brightness of Zinc | G | G | G | G | G | G | G | G | G | G |
| Current Efficiency at the Cathode (%) | 74 | 72 | 75 | 74 | 71 | 73 | 68 | 47 | 45 | 42 |

Note: 1) "Amount of Addition" shows the amount of the brightener additive solution diluted to 200g with water.
2) "G" is an abbreviated word of "Good".

In the above table, the results which the brightener additive solutions prepared without addition of dimethylamine, hexamethylenetetramine and diethylamine in each Example Nos. 1, 3 and 6 (Example Nos. 1', 3' and 6') were added to the electroplating baths, respectively and the electroplating of zinc on steel was performed under the same conditions described above were supplemented to compare with the effects of this invention.

When 0.3 g/l of a prior art brightener additive: anisic aldehyde and vanillin was added to each of the zinc electrodepositing baths containing the brightness of Example Nos. 1–7 and when steel was electroplated with each bath under the same conditions described above, it was found that a more bright zinc layer was electrodeposited on the steel in each instance.

What is claimed is:

1. A method for the electrodeposition of a bright zinc, which comprises:

electrodepositing the zinc from an aqueous zinc electrode depositing bath comprising an aqueous solution containing a source of zinc ions and an effective amount, sufficient to yield a bright zinc electrodeposit, of a water soluble polymer prepared by the reaction of at least one epihalohydrin with at least one nitrogen heterocyclic compound selected from the group consisting of imidazole, pyrrole, piperazine and compounds thereof, and at least one compound selected from the group consisting of aliphatic amines, hexamethylene tetramine and ammonia, wherein 0.2 – 5 moles of said epihalohydrin is reacted with 0.2 – 10 moles of said aliphatic amine, ammonia or hexamethylene tetramine per mole of said nitrogen heterocyclic compound at 50°– 100°C.

2. The method of claim 1, wherein said imidazole compound comprises at least one imidazole compound having a ring hydrogen atom and/or the hydrogen atom of the imino radical of said imidazole compound substituted with a radical selected from the group consisting of OH, alkyl, amino and acetyl.

3. The method of claim 2, wherein said imidazole compound is selected from the group consisting of 1-methyl imidazole, 2-methyl imidazole, 1,4-dimethyl imidazole, 4-hydroxy-2-amino imidazole and 5-ethyl-4-hydroxy imidazole.

4. The method of claim 1, wherein said aliphatic amines are selected from the group consisting of methylamine, dimethylamine, ethylamine, diethylamine, triethylamine, ethylene diamine and diethylene triamine.

5. The method of claim 1, wherein said pyrrole compound comprises at least one pyrrole compound having a ring hydrogen atom and/or the hydrogen atom of the imino radical substituted with a radical selected from the group consisting of OH, alkyl, amino and acetyl.

6. The method of claim 5, wherein said pyrrole compound is selected from the group consisting of 2,5-dimethyl pyrrole, 1-ethyl pyrrole, 1-acetyl pyrrole and 1-methyl pyrrole.

7. The method of claim 1, wherein said piperazine compound comprises at least one piperazine compound having a ring hydrogen atom and/or the hydrogen atom of the imine radical of said piperazine compound substituted with a radical selected from the group consisting of alkyl and acetyl.

8. The method of claim 7, wherein said piperazine compound is selected from the group consisting of N,N′-dimethyl piperazine, N,N′-diethyl piperazine, 1,4-ethylene piperazine and 2,5-dimethyl piperazine.

9. The method of claim 1, wherein the epihalohydrin is selected from the group consisting of epichlorohydrin and epibromohydrin.

* * * * *